US009283575B2

(12) United States Patent
Zhou et al.

(10) Patent No.: US 9,283,575 B2
(45) Date of Patent: Mar. 15, 2016

(54) SHOWER

(75) Inventors: Huasong Zhou, Xiamen (CN); Wei Zhang, Xiamen (CN); Jianmin Chen, Xiamen (CN); Yangwang Liu, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 312 days.

(21) Appl. No.: 13/980,678

(22) PCT Filed: Dec. 31, 2011

(86) PCT No.: PCT/CN2011/085110

§ 371 (c)(1),
(2), (4) Date: Jul. 19, 2013

(87) PCT Pub. No.: WO2012/092834

PCT Pub. Date: Jul. 12, 2012

(65) Prior Publication Data

US 2014/0008464 A1 Jan. 9, 2014

(30) Foreign Application Priority Data

Jan. 5, 2011 (CN) ..... 2011 1 0001324

(51) Int. Cl.
*B05B 1/16* (2006.01)
*B05B 1/18* (2006.01)

(52) U.S. Cl.
CPC ..... *B05B 1/1654* (2013.01); *B05B 1/1645* (2013.01); *B05B 1/1681* (2013.01); *B05B 1/18* (2013.01)

(58) Field of Classification Search
CPC ..... B05B 1/18; B05B 1/185; B05B 1/1645; B05B 1/1654
See application file for complete search history.

(56) References Cited

U.S. PATENT DOCUMENTS

| | | | | |
|---|---|---|---|---|
| 6,412,711 | B1 * | 7/2002 | Fan | 239/446 |
| 7,114,666 | B2 | 10/2006 | Luettgen et al. | |
| 7,896,259 | B2 * | 3/2011 | Meisner et al. | 239/383 |
| 8,276,834 | B2 * | 10/2012 | Qiu et al. | 239/449 |
| 2005/0263617 | A1 * | 12/2005 | Thong | 239/383 |

FOREIGN PATENT DOCUMENTS

| | | | |
|---|---|---|---|
| CN | 1272405 | A | 11/2000 |
| CN | 201482597 | U | 5/2010 |
| CN | 201609681 | U | 10/2010 |
| JP | 2004105791 | A | 4/2004 |

* cited by examiner

*Primary Examiner* — Ryan Reis
(74) *Attorney, Agent, or Firm* — Rabin & Berdo, P.C.

(57) ABSTRACT

A shower has a fixed unit and an outlet unit. The fixed unit is disposed with an inlet waterway and, the outlet unit is disposed with a first outlet cavity to connect to the inlet waterway and several first outlet nozzles, which are connected to the first outlet cavity. Each of the first outlet nozzles is assembled with a diverter in interference fit way inside, the external revolution surface of the diverter is disposed with side grooves, each side groove is disposed with an oblique groove to make the water flowing of the first outlet cavity rotated when the water flowing is entered into the diverter, the diverter is disposed with centre holes throughout along the axis; the first outlet cavity is disposed with a moving plate inside; the outlet unit is connected to the fixed unit in rotating way, the plate can move between a first and second state.

19 Claims, 15 Drawing Sheets

SHOWER

FIELD OF THE INVENTION

The present invention relates to a shower.

BACKGROUND OF THE INVENTION

The existing shower usually includes a fixed unit and an outlet unit, the fixed unit is disposed with an inlet waterway, the outlet unit is disposed with a first outlet cavity to connect to the inlet waterway, several first outlet nozzles to connect to the first outlet cavity, a second outlet cavity to connect to the inlet waterway and several second outlet nozzles to connect to the second outlet cavity, thereinto: the outlet cavity, the outlet nozzle and the water type are corresponding one to one. It has disadvantages: it can not share one outlet nozzle to realize different water types, so that it occupies more space, uses more materials and costs more.

SUMMARY OF THE INVENTION

The present invention is provided with a shower, which overcomes the disadvantages of the existing technology.

The technical proposal of the present invention to solve the technical problems is as below:

A shower, comprising a fixed unit (1) and an outlet unit (2), the fixed unit (1) is disposed with an inlet waterway (11), the outlet unit (22) is disposed with a first outlet cavity (21) to connect to the inlet waterway (11) and several first outlet nozzles (22), which are connected to the first outlet cavity (21), each of the first outlet nozzles (22) is assembled with a diverter (23) in interference fit way inside, the external revolution surface of the diverter (23) is disposed with side grooves (231), each side groove (231) is disposed with an oblique groove (2311) to make the water flowing of the first outlet cavity (21) rotated when the water flowing is entered into the diverter (23), the diverter (23) is disposed with centre holes (232) throughout along the axis; the first outlet cavity (21) is disposed with a moving plate (24) inside; the outlet unit (2) is connected to the fixed unit (1) in rotating way, the plate (24) can move between a first state and a second state when the plate (24) is rotated, thereinto: when the plate (24) is situated in the first state, the central hole (232) is closed; when the plate (24) is situated in the second state, the centre holes (232) are open.

In another preferred embodiment, the outlet unit (2) is further disposed with a second outlet cavity (25) connected to the inlet waterway (11) and several second outlet nozzles (26), which are connected to the second outlet cavity (25); the relative rotation between the outlet unit (2) and the fixed unit (1) realizes the switch of the first outlet cavity (21) and the second outlet cavity (25) to connect to the inlet waterway (11).

In another preferred embodiment, the first outlet nozzle (22) and the second outlet nozzle (26) share a cover (28).

In another preferred embodiment, an elastic piece (27) is disposed between the plate (24) and the outlet unit (2), the elastic piece (27) generates elastic force to make the plate (24) moving from the second state to the first state.

In another preferred embodiment, the fixed unit (1) includes a fixed shaft (12), the outlet unit (2) is connected to the fixed unit (1) and sleeved to the fixed shaft (12) in rotating way; the fixed shaft (12) is disposed with a boss (121) in the lower, the boss (121) is disposed with a first helical surface (1211); the connection relationship of the plate (24) and the outlet unit (2) is synchronous concentric rotary and relative sliding up and down, the plate (24) is disposed with a second helical surface (241); thereinto: when the outlet unit (2) rotates relatively to the fixed unit (1), the plate (24) rotates with the outlet unit (2) relatively to the boss (121), the first helical surface (1211) is cooperated with the second helical surface (241) to make the plate (24) sliding up and down relatively to the outlet unit (2) to make the plate (24) moving between the first state and the second state.

In another preferred embodiment, the plate (24) is disposed with sealing columns (242) with same number with the diverter (23), thereinto: when the plate (24) is situated in the first state, the sealing columns (242) seal up the central holes (232); when the plate (24) is situated in the second state, the centre holes (232) are separated from the sealing columns (242).

In another preferred embodiment, the fixed unit (1) is disposed with a fixed shaft (12), the outlet unit (2) is connected to the fixed unit (1) and sleeved to the fixed shaft (12) in rotating way; the plate (24) is fixed outside the fixed shaft (12), the plate (24) is disposed with sealing columns (242) with same number with the diverter (23) in the lower; the outlet unit (2) rotates relatively to the fixed unit (1), the outlet unit (2) rotates relatively to the plate (24), thereinto: when the plate (24) is situated in the first state, the sealing columns (242) seal up the centre holes (232); when the plate (24) is situated in the second state, the sealing columns (242) are separated from the centre holes (232).

In another preferred embodiment, the fixed unit (1) is disposed with a fixed shaft (12), the outlet unit (2) is connected to the fixed unit (1) and sleeved to the fixed shaft (12) in rotating way; the fixed shaft (12) is disposed with external screw thread section; the connection relationship of the plate (24) and the outlet unit (2) is synchronous concentric rotary and relative sliding up and down, the plate (24) is threaded to the screw thread section of the fixed shaft (12); thereinto: when the outlet unit (2) rotates relatively to the fixed unit (1), the plate (24) rotates with the outlet unit (2), the plate (24) is threaded and cooperated to the fixed unit (12) to make the plate (24) sliding up and down relatively to the outlet unit (2) to make the plate (24) moving between the first state and the second state.

In another preferred embodiment, the plate (24) is disposed with sealing columns (242) with same number with the diverter (23) in the lower, thereinto: when the plate (24) is situated in the first state, the sealing columns (242) seal up the centre holes (232); when the plate (24) is situated in the second state, the centre holes (232) are separated from the sealing columns (242).

In another preferred embodiment, the back side of the cover (28) is extended out with two round walls of concentric, the space inside the internal round wall forms to be the first outlet cavity (21), the space between the internal round wall and the external round wall forms to be the second outlet cavity (25), the first outlet cavity (21) is relative independent from the second outlet cavity (25).

Compared to the existing technology, the technical proposal of the present invention has advantages as below:

1. The water type of the first outlet nozzle is controlled by the on-off of the centre holes, realizing different water types from one outlet cavity and one outlet nozzle, it reduces the size and the materials, and it costs lower as well; the on-off of the centre hole is controlled by the relative rotary of the outlet unit and the fixed unit, the control is convenient and quick.
2. the switch of the first outlet cavity and the second outlet cavity to connect to the inlet waterway is realized by the relative rotation of the outlet unit and the fixed unit, the water type of the first outlet nozzle and the waterway switch are combined, the switch is convenient and quick.

3. the outlet unit rotates relatively to the fixed unit to drive the plate to rotate, with the cooperation of the first helical surface and the second helical surface, the plate slides up and down to control the on-off of the centre hole, the control is convenient, the structure is simple and rational.
4. the outlet unit rotates relatively to the fixed unit to make outlet unit rotated relatively to the plate to control sealing columns to close the centre holes or depart away to control the on-off of the centre hole, the control is convenient, the structure is simple and rational.
5. the outlet unit rotates relatively to the fixed unit to drive the plate to rotate, then the plate is threaded to the fixed shaft to make the plate moving up and down to control the on-off of the centre hole, the control is convenient, the structure is simple and rational.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
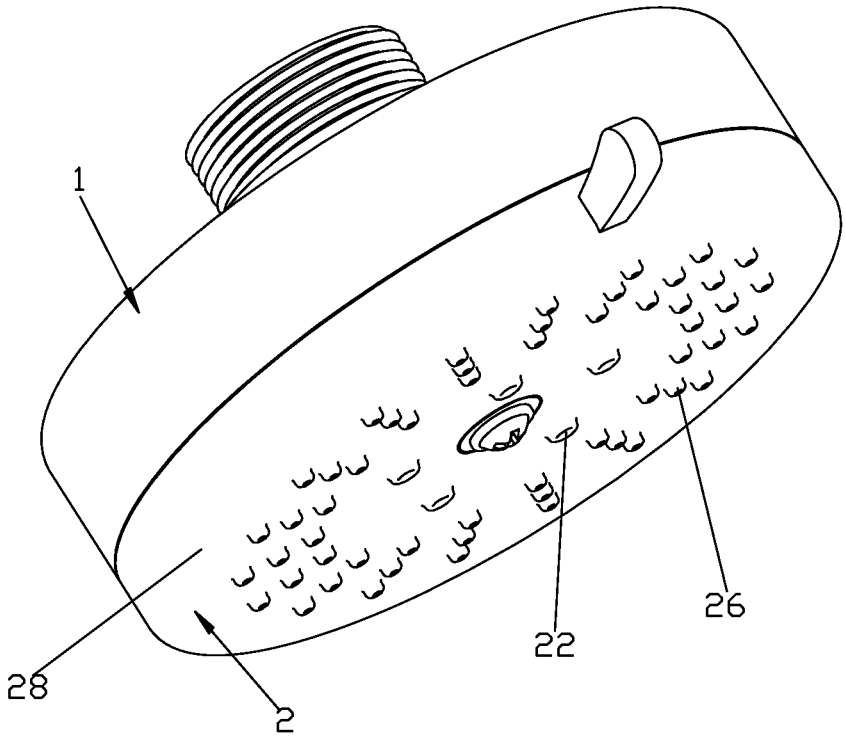
FIG. 1 illustrates the structure of the shower of the first embodiment.
Figure 2:
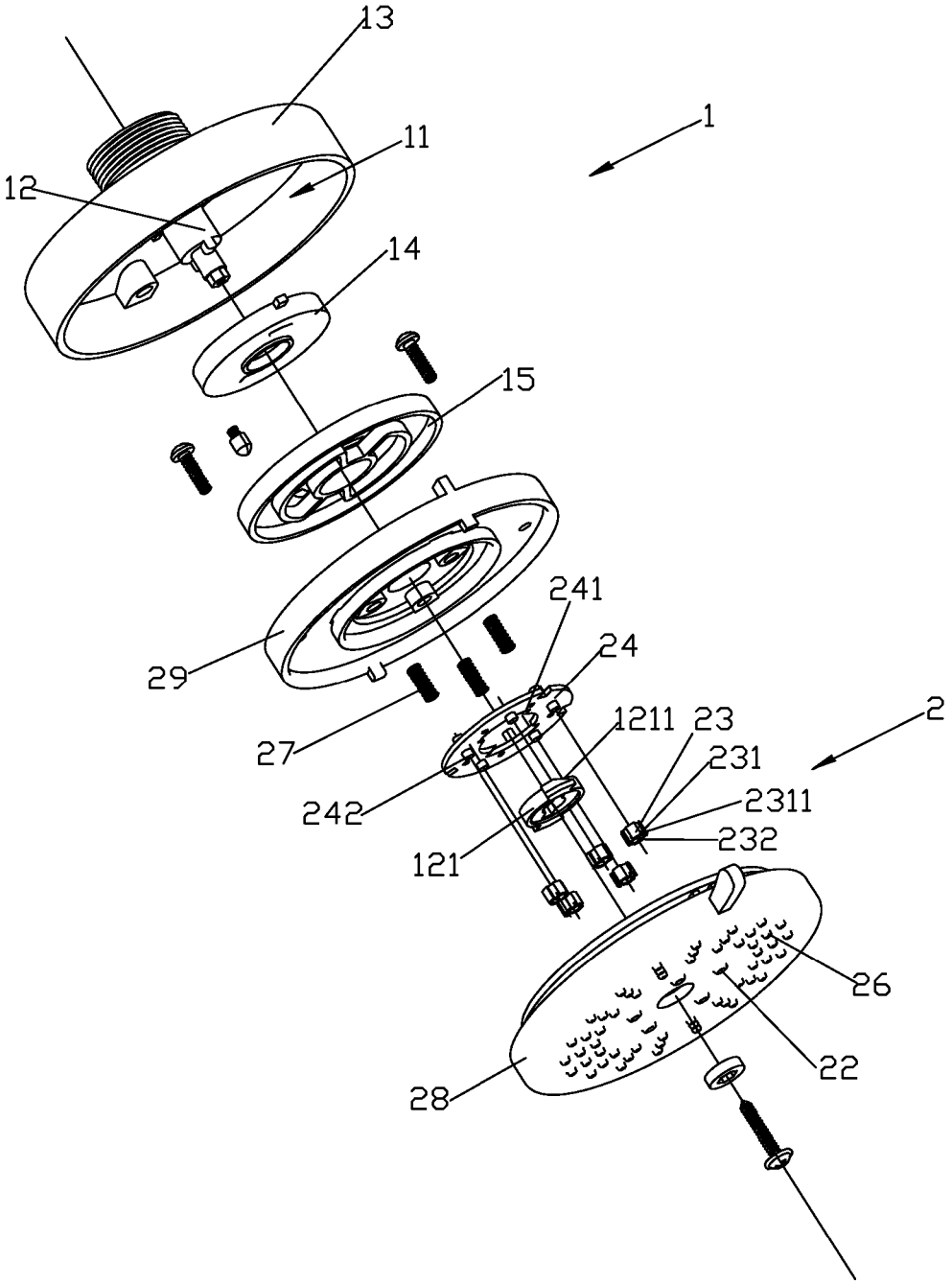
FIG. 2 illustrates the breakdown structure of the shower of the first embodiment.
Figure 3:
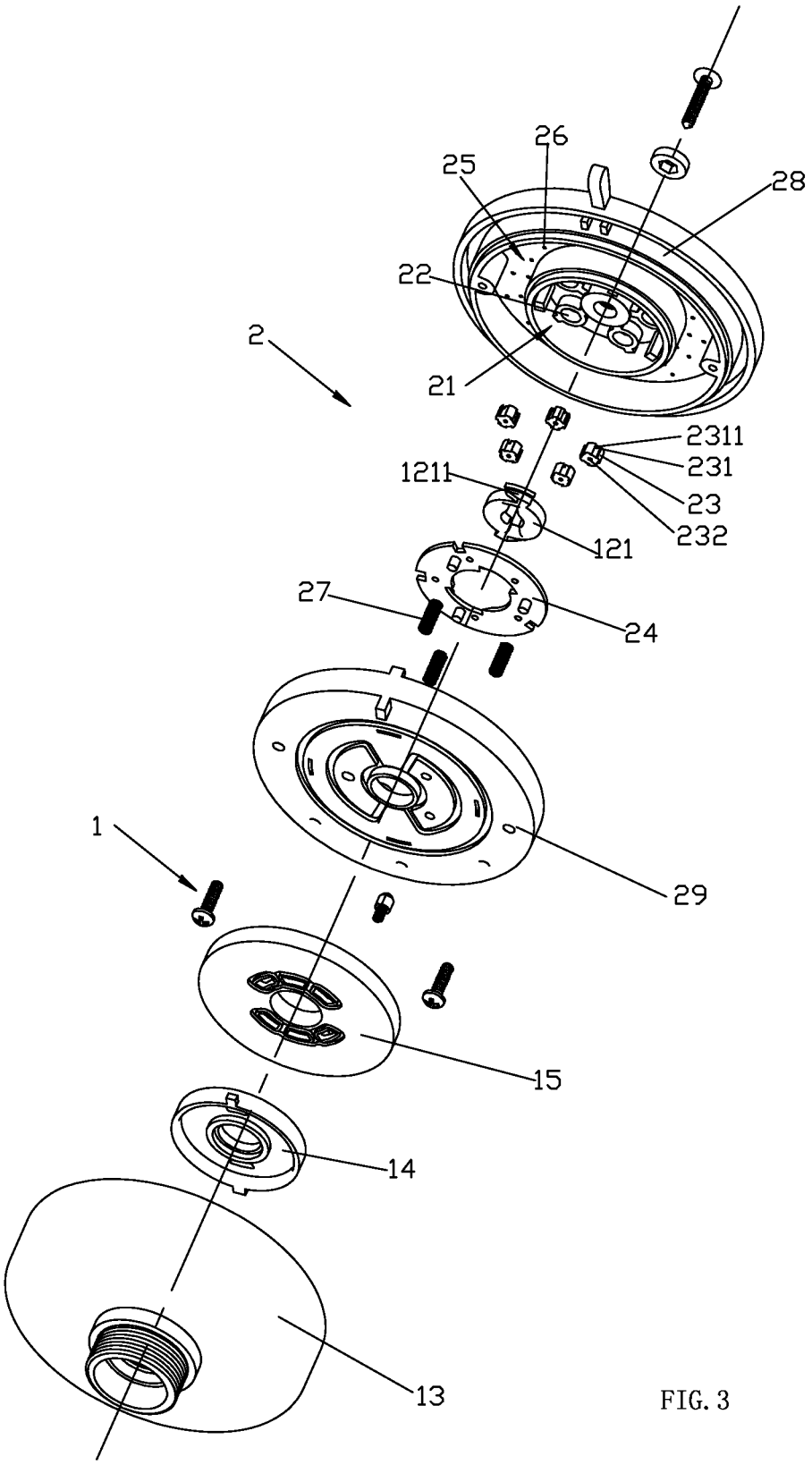
FIG. 3 illustrates the breakdown structure of the shower of the first embodiment in another view angle.
Figure 4:
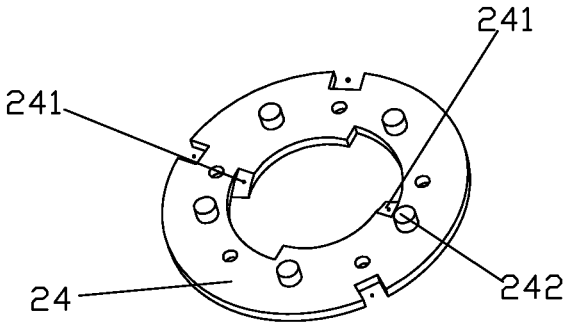
FIG. 4 illustrates the structure of the plate of the first embodiment.
Figure 5:
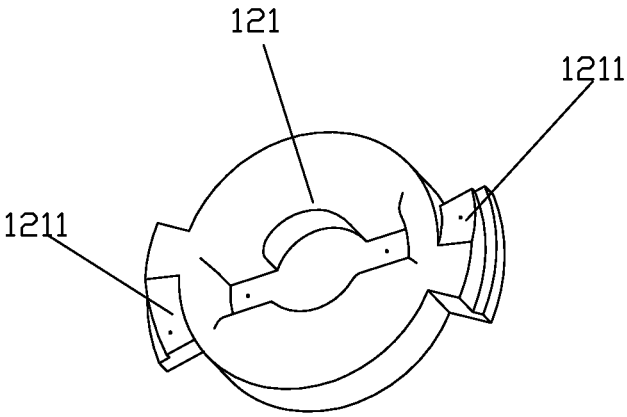
FIG. 5 illustrates the structure of the boss of the first embodiment.
Figure 6:
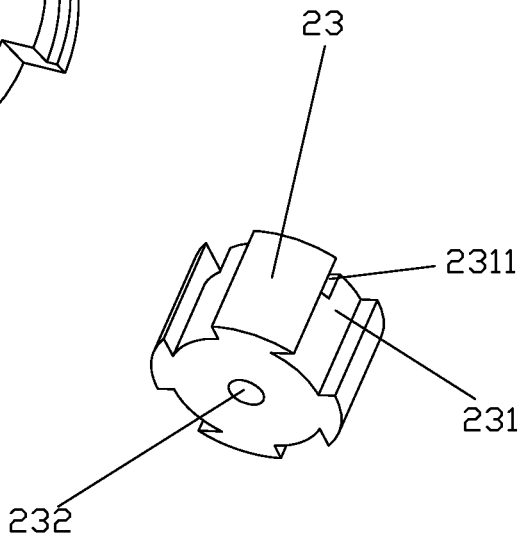
FIG. 6 illustrates the structure of the diverter of the first embodiment.
Figure 7:
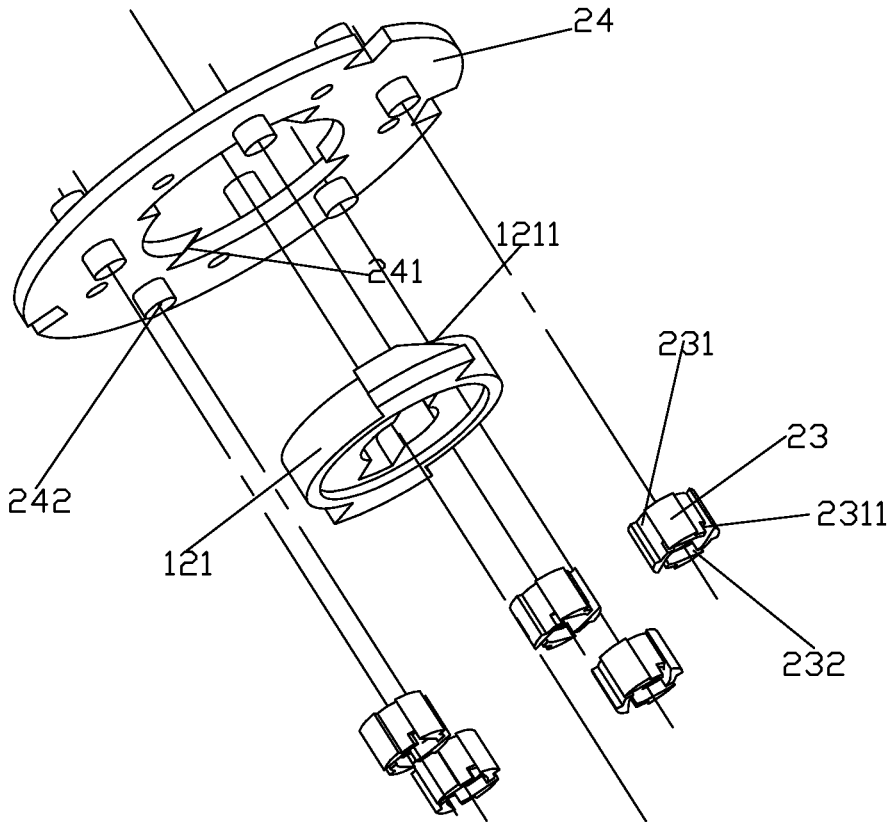
FIG. 7 illustrates the structure of the plate, the bosses and the diverter of the first embodiment.
Figure 8:
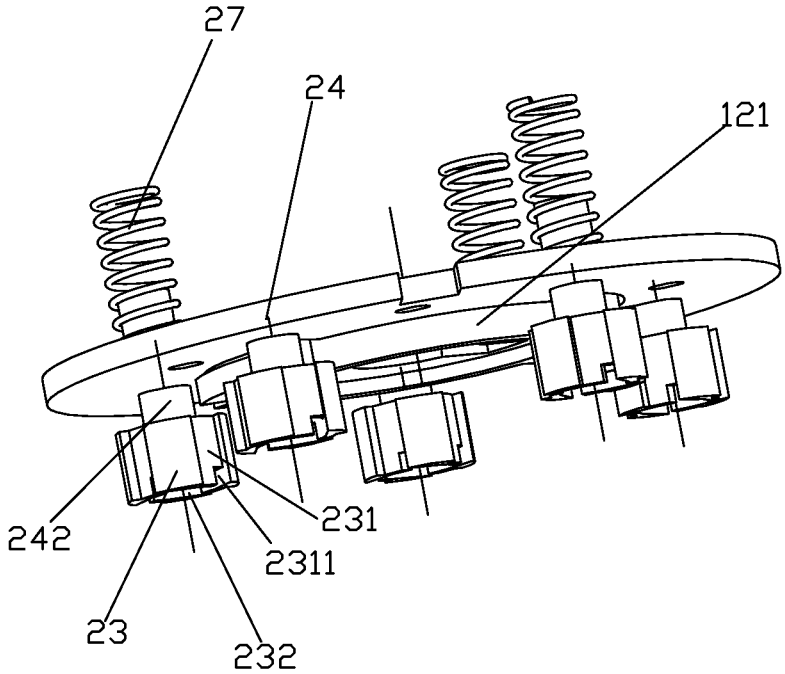
FIG. 8 illustrates the assembly of the plate, the bosses and the diverter of the first embodiment when the plate is situated in the first state.
Figure 9:
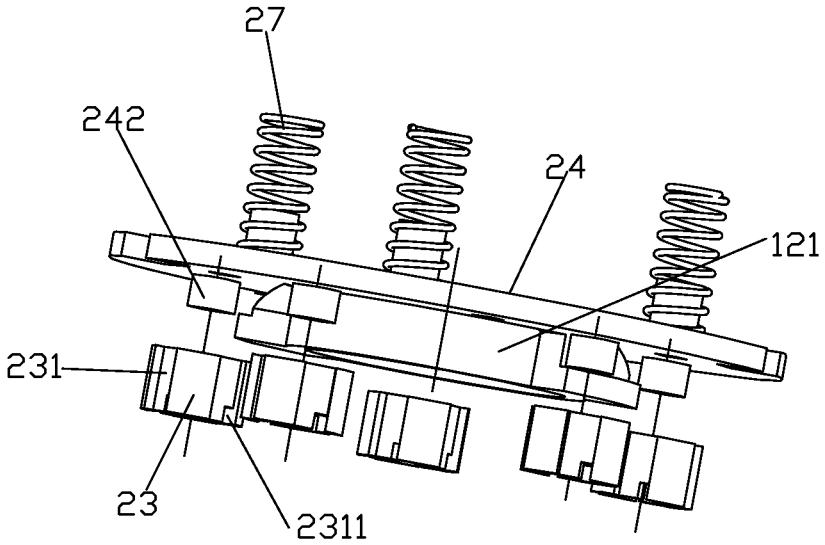
FIG. 9 illustrates the assembly of the plate, the bosses and the diverter of the first embodiment when the plate is situate in the second state.
Figure 10:
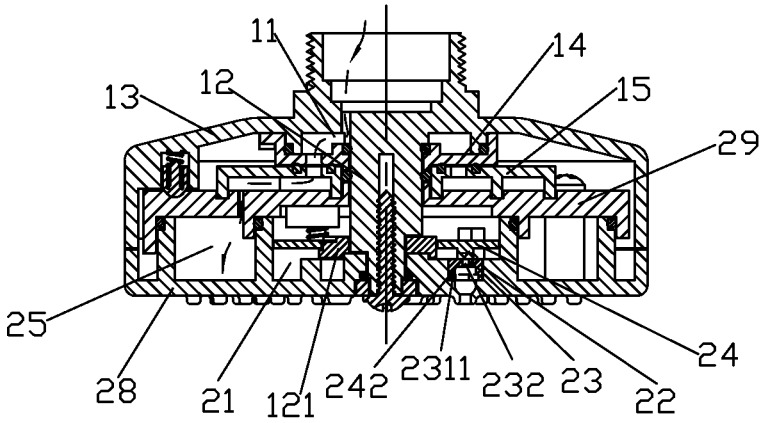
FIG. 10 illustrates the sectional view of the shower of the first embodiment when it runs out shower water.
Figure 11:
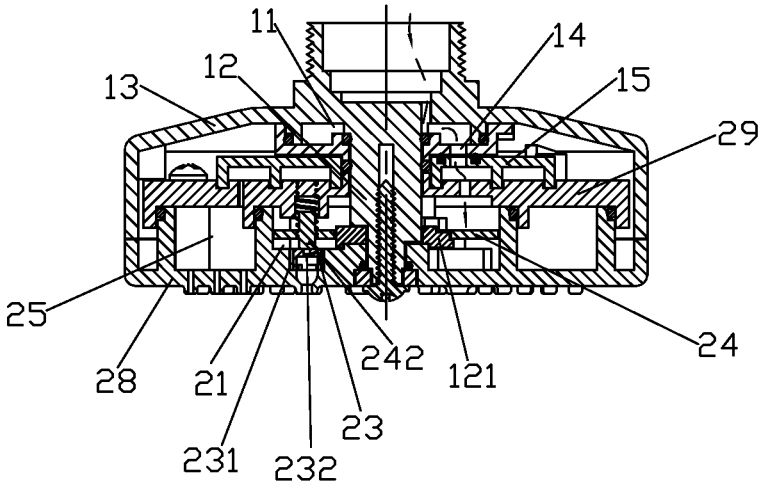
FIG. 11 illustrates the sectional view of the shower of the first embodiment when it runs out spray water.
Figure 12:
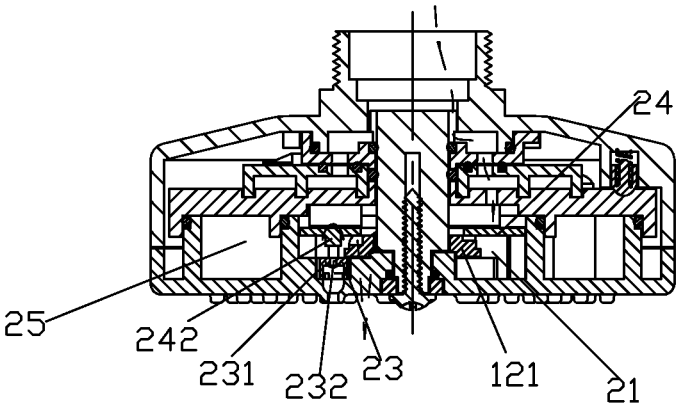
FIG. 12 illustrates the sectional view of the shower of the first embodiment when it runs out combination water.
Figure 13:
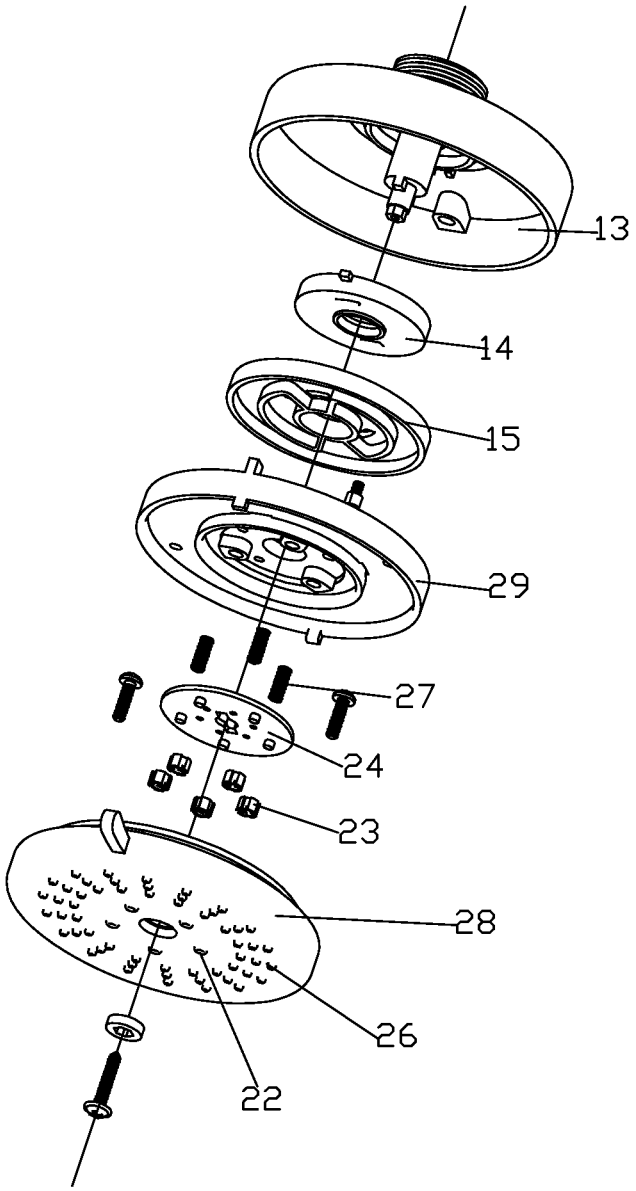
FIG. 13 illustrates the breakdown structure of the shower of the second embodiment.
Figure 14:
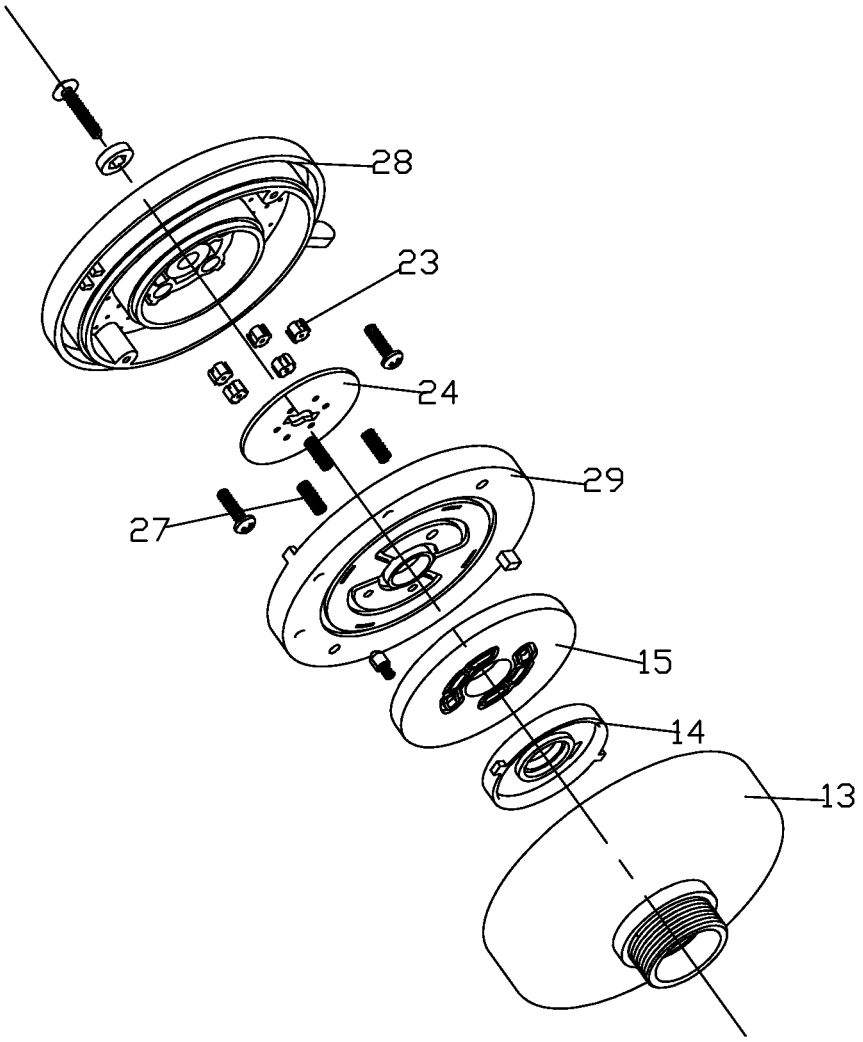
FIG. 14 illustrates the breakdown structure of the shower of the second embodiment in another angle view.

Please refer to FIG. 1 to FIG. 12. A shower includes a fixed unit 1 and an outlet unit 2, the outlet unit 2 is connected to the fixed unit 1 in rotating way.

The fixed unit 1 includes a body 13, a support cover 14 and an upper water diversion body 15, the body 13, the support cover 14 and the upper water diversion body 15 are fixed together and then formed with an inlet waterway 11 to connect to the water resource. In this embodiment, the body 13 is further disposed with a fixed shaft 12, the lower end of which is passing through the support cover 14 and the upper water diversion body 15 and extending out.

The outlet unit 2 includes a lower water diversion body 29 and a cover 28.

The back side of the cover 28 is extended out with two round walls of concentric, the lower water diversion body 29 is fixed to the cover 28 in sealing way, making the space inside internal round wall formed a first outlet cavity 21 and the space between the internal round wall and the external round wall formed a second outlet cavity 25, the first outlet cavity 21 is relatively independent from the second outlet cavity 25.

The lower water diversion body 29 is disposed with a first water diversion hole and a second water diversion hole separately connected to the first outlet cavity 21 and the second outlet cavity 25. the outlet unit 2 is connected to the fixed unit 1 in rotating way, so that the outlet unit 2 is rotated to a first position, a third position and a second position relatively to the fixed unit 1, thereinto: when the outlet unit 2 is situated in the first position or the third position, the first water diversion hoe is connected to the inlet waterway 11 and the first outlet cavity 21 is connected to the inlet waterway 11; when the outlet unit 2 is situated in the second position, the second water diversion hole is connected to the inlet waterway 11 and the second outlet cavity 25 is connected to the inlet waterway 11. But not limited to this, it can dispose two first water diversion holes and a second water diversion hole in the lower water diversion body 29. The outlet unit 2 is assembled to the fixed unit 1 in rotating way, and it is sleeved to the fixed shaft 12 in rotating way, making the outlet unit 2 rotated to the first position, the third position and the second position relatively to the fixed unit 1, thereinto: when the outlet unit 2 is situated in the first position, one of the first water diversion hole is connected to the inlet waterway 11, the first outlet cavity 21 is connected to the inlet waterway 11, as figured in FIG. 11, it runs out spray water; when the outlet unit 2 is situated in the second position, the second water diversion hole is connected to the inlet waterway 11, the second outlet cavity 25 is connected to the inlet waterway 11, it runs out shower water, as figured in FIG. 10; when the outlet unit 2 is situated in the third position, the other first water diversion hole is connected to the inlet waterway 11, the first outlet cavity 21 is connected to the inlet waterway 11, as figured in FIG. 11, it runs out combination water.

The cover 28 includes several first outlet nozzles 22 corresponding to the first outlet cavity 21 and several second outlet nozzles 26 corresponding to the second outlet cavity 25.

The first outlet nozzle 22 is assembled with a diverter 23 in interference fit way, the outside revolution surface of the diverter 23 is disposed with side grooves 231, the side groove 231 is disposed with an oblique groove 2311 to make the water flowing of the first outlet cavity 21 rotated when the water flowing is entered into the diverter 23, the diverter 23 is disposed with centre holes 232 throughout along the axis. the first outlet cavity 21 is disposed with a moving plate 24 inside, the cover is disposed with sealing columns 242 with the same number with the diverter 23. The outlet unit 2 is connected to the fixed unit 1 in rotating way, the plate 24 can move between a first state and a second state when the plate 24 is rotated, thereinto: when the plate 24 is situated in the first state, the sealing columns 242 seal up the centre holes 232, the water of the first outlet cavity 21 enters into the diverter 23 and rotates and then runs out to be spray water; when the plate 24 is situated in the second state, the sealing columns 242 are separated from the centre holes 232, the centre holes 232 are open, the water of the centre holes 232 and the water of the side groove 231 impacts to generate granule to form combination water.

In this embodiment:

An elastic piece 27 is disposed between the plate 24 and the lower water diversion body 29 of the outlet unit 2 to generate elastic force to make the plate 24 moved from the second state to the first state.

The fixed shaft 12 is disposed with a boss 121 in the lower, the boss 121 is disposed with a first helical surface 1211; the connection relationship of the plate 24 and the outlet unit 2 is synchronous concentric rotary and relative sliding up and down (this connection relationship can apply with the following structure: a sliding groove is disposed in the plate 24 along the axis direction, a plug-in piece is disposed in the outlet unit 2, the plug-in piece is coupled to the sliding groove), the plate 24 is disposed with a second helical surface 241; thereinto: when the outlet unit 2 rotates relatively to the fixed unit 1, the plate 24 rotates with the outlet unit 2 relatively to the boss 121, the first helical surface 1211 is cooperated with the second helical surface 241 to make the plate 24 sliding up and down relatively to the outlet unit 2 to make the plate 24 moving between the first state and the second state. Thereinto: when the plate 24 is situated in the first state, under the work of the elastic force of the elastic piece, the sealing columns 242 seal up the centre holes 232, as figured in FIG. 8; when the plate 24 is situated in the second state, the sealing columns 242 are separated from the centre holes 232, as figured in FIG. 9.

The Second Embodiment

Figure 15:
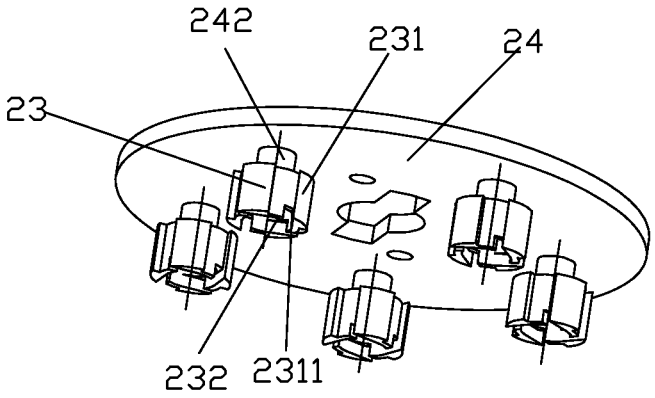
FIG. 15 illustrates the assembly of the plate and the diverter of the second embodiment when the plate is situated in the first state.
Figure 16:
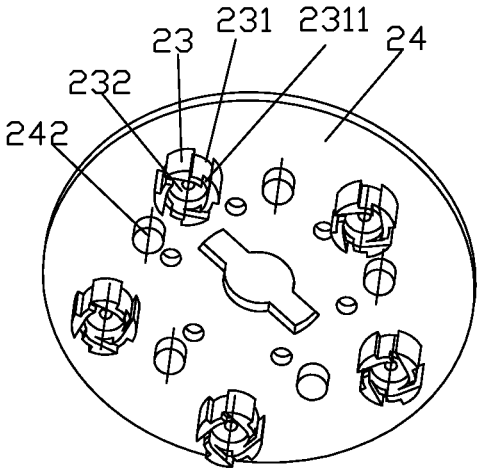
FIG. 16 illustrates the assembly of the plate and the diverter of the second embodiment when the plate is situated in the second plate.
Figure 17:
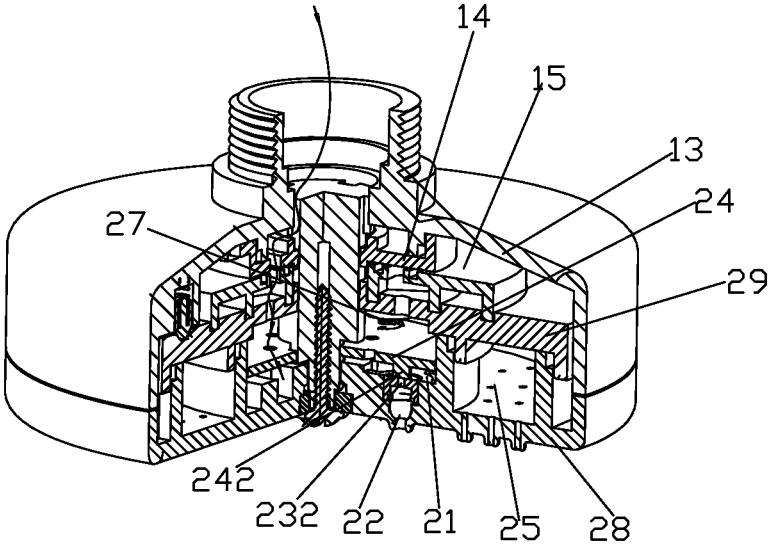
FIG. 17 illustrates the sectional view of the shower of the second embodiment when it runs out spray water.
Figure 18:
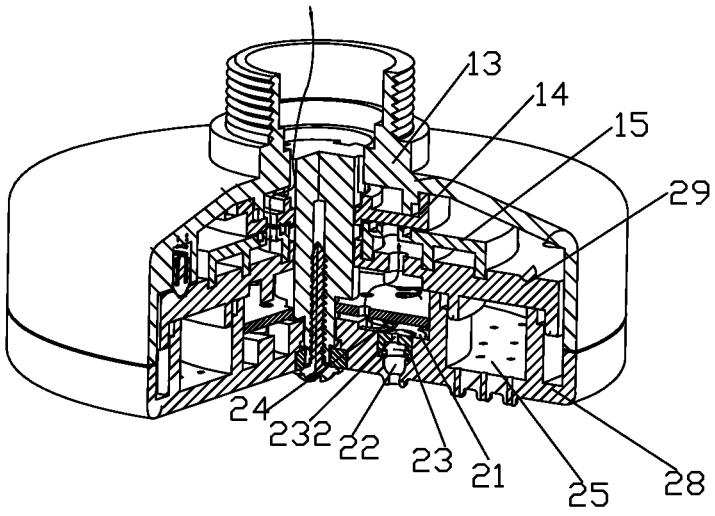
FIG. 18 illustrates the sectional view of the shower of the second embodiment when it runs out combination water.
Figure 19:
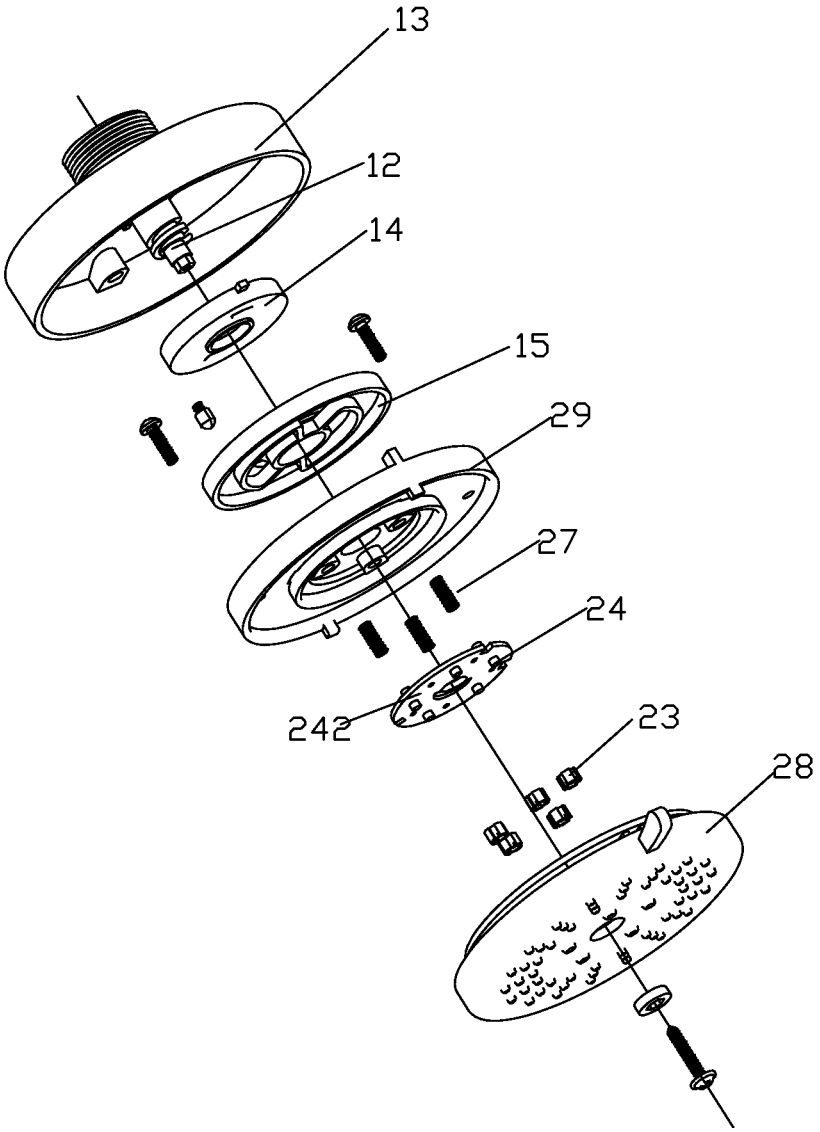
FIG. 19 illustrates the breakdown structure of the shower of the third embodiment.
Figure 20:
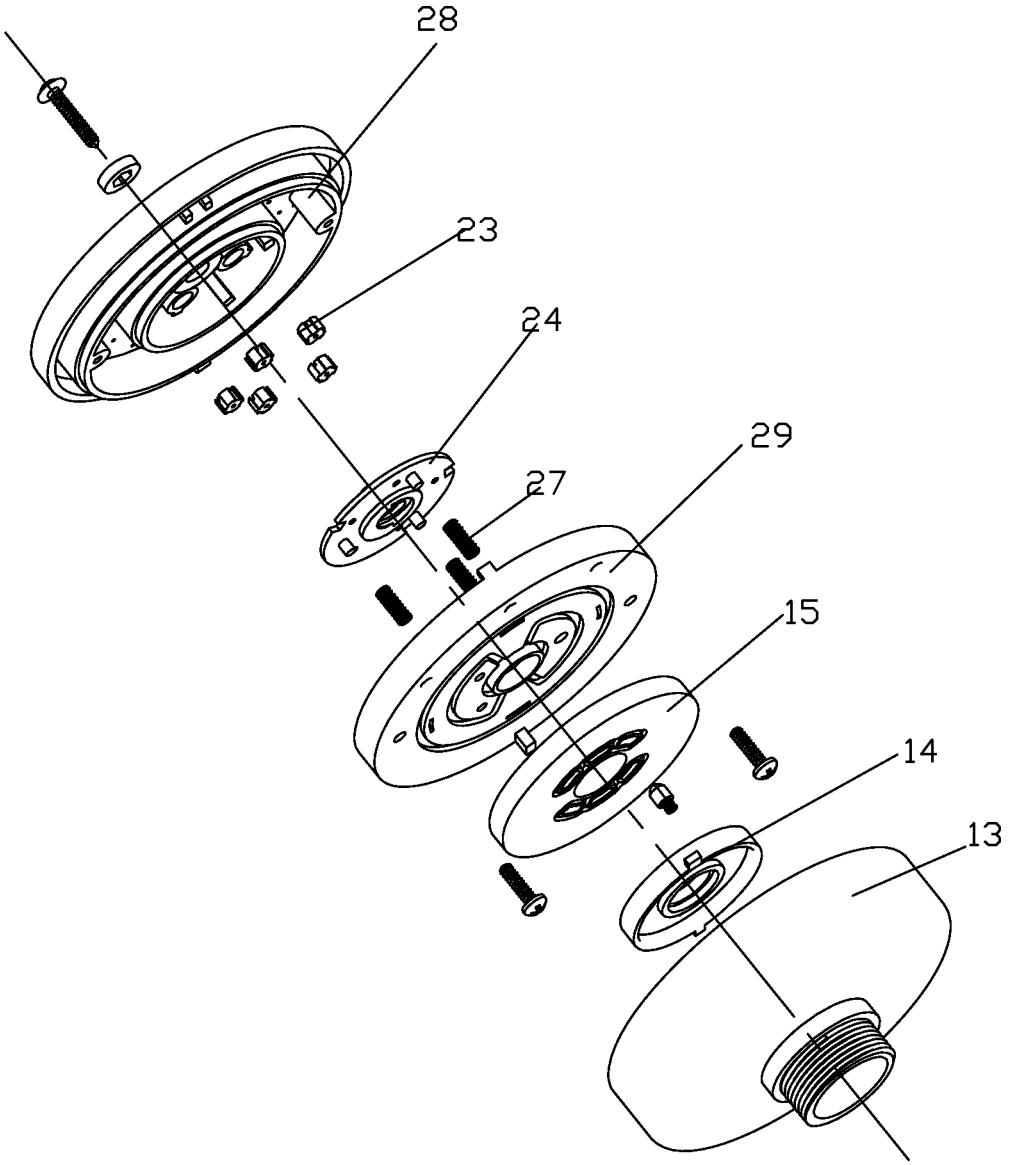
FIG. 20 illustrates the breakdown structure of the shower of the third embodiment in another view angle.
Figure 21:
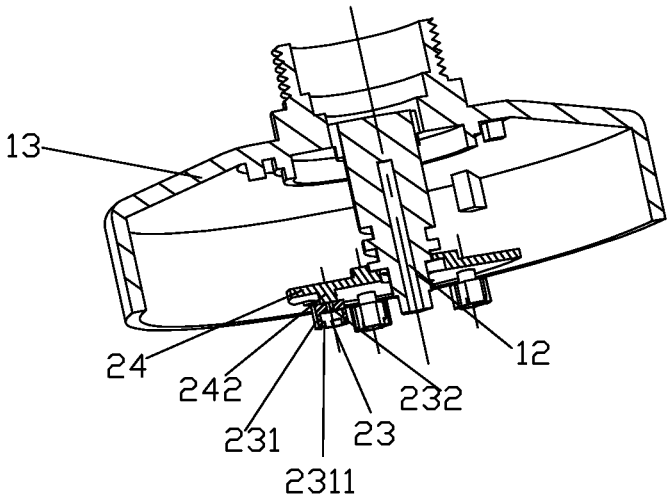
FIG. 21 illustrates the structure of the shower of the third embodiment when the plate is situated in the first state.
Figure 22:
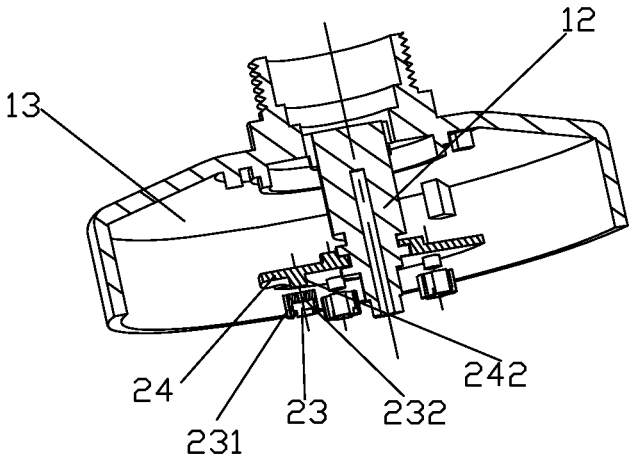
FIG. 22 illustrates the structure of the shower of the third embodiment when the plate is situated in the second state.
Figure 23:
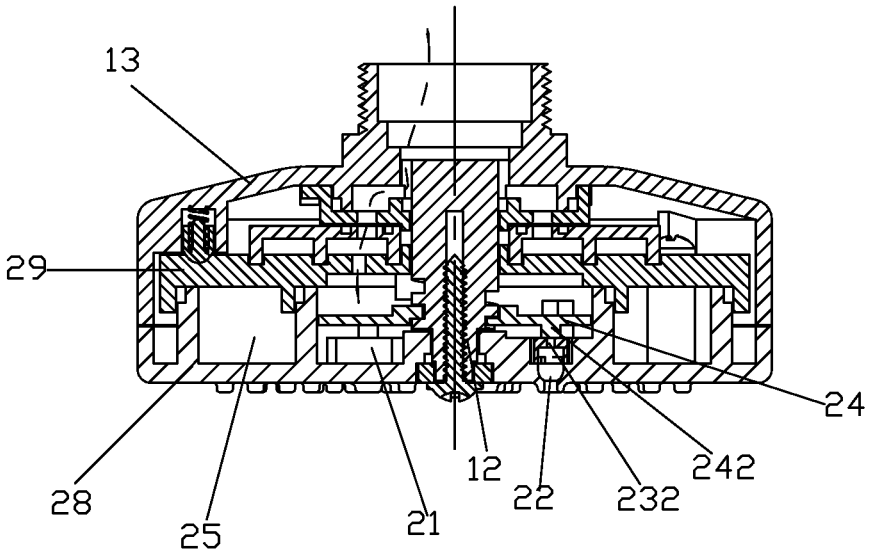
FIG. 23 illustrates the sectional view of the shower of the third embodiment when it runs out spray water.
Figure 24:
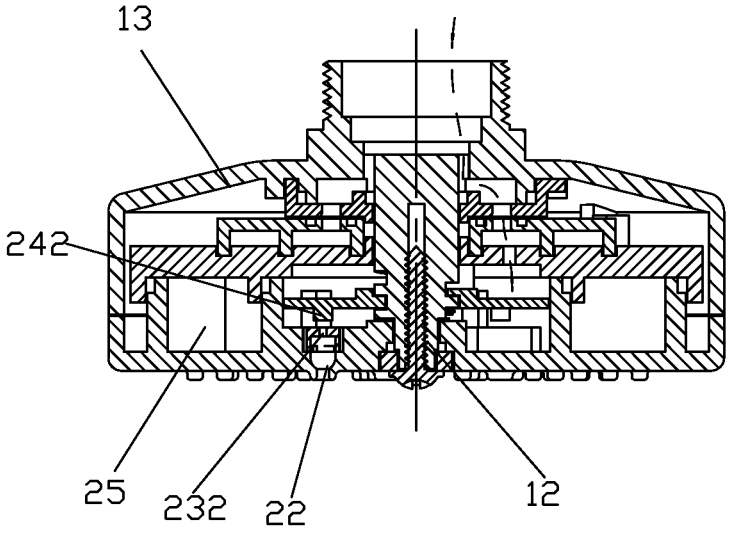
FIG. 24 illustrates the sectional view of the shower of the third embodiment when it runs out combination water.

Please refer to FIG. 13 to FIG. 18, the difference of this embodiment from the first embodiment is as below:

The plate 24 is fixed outside the fixed shaft 12, the outlet unit 2 rotates relatively to the fixed unit 1, the plate 24 rotates relatively to the outlet unit 2, thereinto: when the plate 24 is situated in the first state, the sealing columns 242 seal up the centre holes 232, as figured in FIG. 15 and FIG. 17; when the plate 24 is situated in the second state, the sealing columns 242 are separated from the centre holes 232, as figured in FIG. 16 and FIG. 18.

The Third Embodiment

Please refer to FIG. 19 to FIG. 24, the difference from the first embodiment is that:

The fixed shaft 12 is disposed with external screw thread section, the connection relationship of the plate 24 and the outlet unit 2 is synchronous concentric rotary and relative sliding up and down, the plate 24 is threaded to the screw thread section of the fixed shaft 12; thereinto: when the outlet unit 2 rotates relatively to the fixed unit 1, the plate 24 rotates with the outlet unit 2, the plate 24 is threaded and cooperated to the fixed unit 12 to make the plate 24 sliding up and down relatively to the outlet unit 2 to make the plate 24 moving between the first state and the second state. Thereinto: when the plate 24 is situated in the first state, the sealing columns 242 seal up the centre holes 232, as figured in FIG. 21 and FIG. 23; when the plate 24 is situated in the second state, the sealing columns 242 are separated from the centre holes 232, as figured in FIG. 22 and FIG. 24.

Industrial Applicability

The present invention is provided with a shower, in which The water type of the first outlet nozzle is controlled by the on-off of the centre hole, realizing different water types from one outlet cavity and one outlet nozzle, it reduces the size and the materials, and it costs lower as well; the on-off of the centre hole is controlled by the relative rotary of the outlet unit and the fixed unit, the control is convenient and quick. The present invention is with well industrial applicability.

What is claimed is:

1. A shower, comprising
- a fixed unit and an outlet unit,
- the fixed unit is disposed with an inlet waterway,
- the outlet unit is disposed with a first outlet cavity to connect to the inlet waterway and several first outlet nozzles, which are connected to the first outlet cavity, wherein
- each of the first outlet nozzles is assembled with a diverter in interference fit inside,
- an external revolution surface of the diverter is disposed with side grooves,
- each side groove is disposed with an oblique groove to make the water flowing out of the first outlet cavity rotated when the water flowing is entered into the diverter,
- the diverter is disposed with centre holes throughout along an axis;
- the first outlet cavity is disposed with a moving plate inside;
- the outlet unit is connected to the fixed unit in rotating way,
- the plate can move between a first state and a second state when the plate is rotated, wherein:
- when the plate is situated in the first state, the centre holes are closed;
- when the plate is situated in the second state, the centre holes are open.

2. A shower according to claim 1, wherein
- the outlet unit is further disposed with a second outlet cavity connected to the inlet waterway and several second outlet nozzles, which are connected to the second outlet cavity;
- the relative rotation between the outlet unit and the fixed unit realizes the switch of the first outlet cavity and the second outlet cavity to connect to the inlet waterway.

3. A shower according to claim 2, wherein each first outlet nozzle and each corresponding second outlet nozzle share a cover.

4. A shower according to claim 2, wherein
- an elastic piece is disposed between the plate and the outlet unit,
- the elastic piece generates elastic force to make the plate move from the second state to the first state.

5. A shower according to claim 1, wherein
- the fixed unit includes a fixed shaft,
- the outlet unit is connected to the fixed unit and sleeved to the fixed shaft in rotating way;

the fixed shaft is disposed with a boss
the boss is disposed with a first helical surface;
the plate and the outlet unit are arranged concentrically to each other, configured to rotate synchronously and configured to slide up and down relative to each other,
the plate is disposed with a second helical surface; wherein:
when the outlet unit rotates relative to the fixed unit, the plate rotates with the outlet unit relative to the boss,
the first helical surface is cooperated with the second helical surface to make the plate slide up and down relative to the outlet unit to make the plate move between the first state and the second state.

6. A shower according to claim 5, wherein
the plate is provided with sealing columns equal in number to the diverters, wherein:
when the plate is situated in the first state, the sealing columns seal up the centre holes;
when the plate is situated in the second state, the centre holes are separated from the sealing columns.

7. A shower according to claim 1, wherein
the fixed unit is disposed with a fixed shaft,
the outlet unit is connected to the fixed unit and sleeved to the fixed shaft in rotating way;
the plate is fixed outside the fixed shaft,
the plate is provided with sealing columns equal in number to the diverters;
the outlet unit rotates relative to the fixed unit,
the outlet unit rotates relative to the plate, wherein:
when the plate is situated in the first state, the sealing columns seal up the centre holes;
when the plate is situated in the second state, the sealing columns are separated from the centre holes.

8. A shower according to claim 1,
wherein the fixed unit is disposed with a fixed shaft,
the outlet unit is connected to the fixed unit and sleeved to the fixed shaft in rotating way;
the fixed shaft is disposed with external screw thread section;
the plate and the outlet unit are arranged concentrically to each other, configured to rotate synchronously and configured to slide up and down relative to each other,
the plate is threaded to the screw thread section of the fixed shaft; wherein:
when the outlet unit rotates relative to the fixed unit, the plate rotates with the outlet unit,
the plate is threaded and cooperated to the fixed unit to make the plate slide up and down relative to the outlet unit to make the plate move between the first state and the second state.

9. A shower according to claim 8, wherein
the plate is disposed with sealing columns with same number with the diverter in the lower, wherein:
when the plate is situated in the first state, the sealing columns seal up the centre holes;
when the plate is situated in the second state, the centre holes are separated from the sealing columns.

10. A shower according to claim 3, wherein
a back side of the cover is extended out with internal and external round walls concentric with each other,
the space inside the internal round wall forms to be the first outlet cavity,
the space between the internal round wall and the external round wall forms to be the second outlet cavity,
the first outlet cavity is relative independent from the second outlet cavity.

11. A shower according to claim 2, wherein
the fixed unit is disposed with a fixed shaft,
the outlet unit is connected to the fixed unit and sleeved to the fixed shaft in rotating way;
the plate is fixed outside the fixed shaft,
the plate is provided with sealing columns equal in number to the diverters;
the outlet unit rotates relative to the fixed unit,
the outlet unit rotates relative to the plate, wherein:
when the plate is situated in the first state, the sealing columns seal up the centre holes;
when the plate is situated in the second state, the sealing columns are separated from the centre holes.

12. A shower according to claim 3, wherein
the fixed unit is disposed with a fixed shaft,
the outlet unit is connected to the fixed unit and sleeved to the fixed shaft in rotating way;
the plate is fixed outside the fixed shaft,
the plate is provided with sealing columns equal in number to the diverters;
the outlet unit rotates relative to the fixed unit,
the outlet unit rotates relative to the plate, wherein:
when the plate is situated in the first state, the sealing columns seal up the centre holes;
when the plate is situated in the second state, the sealing columns are separated from the centre holes.

13. A shower according to claim 4, wherein
the fixed unit is disposed with a fixed shaft,
the outlet unit is connected to the fixed unit and sleeved to the fixed shaft in rotating way;
the plate is fixed outside the fixed shaft,
the plate is provided with sealing columns equal in number to the diverters;
the outlet unit rotates relative to the fixed unit,
the outlet unit rotates relative to the plate, wherein:
when the plate is situated in the first state, the sealing columns seal up the centre holes;
when the plate is situated in the second state, the sealing columns are separated from the centre holes.

14. A shower according to claim 2, wherein
the fixed unit is disposed with a fixed shaft,
the outlet unit is connected to the fixed unit and sleeved to the fixed shaft in rotating way;
the fixed shaft is disposed with external screw thread section;
the plate and the outlet unit are arranged concentrically to each other, configured to rotate synchronously and configured to slide up and down relative to each other,
the plate is threaded to the screw thread section of the fixed shaft; wherein:
when the outlet unit rotates relative to the fixed unit, the plate rotates with the outlet unit,
the plate is threaded and cooperated to the fixed unit to make the plate slide up and down relative to the outlet unit to make the plate move between the first state and the second state.

15. A shower according to claim 3, wherein
the fixed unit is disposed with a fixed shaft,
the outlet unit is connected to the fixed unit and sleeved to the fixed shaft in rotating way;
the fixed shaft is disposed with external screw thread section;
the plate and the outlet unit are arranged concentrically to each other, configured to rotate synchronously and configured to slide up and down relative to each other,
the plate is threaded to the screw thread section of the fixed shaft; wherein:

when the outlet unit rotates relative to the fixed unit, the plate rotates with the outlet unit, the plate is threaded and cooperated to the fixed unit to make the plate slide up and down relative to the outlet unit to make the plate move between the first state and the second state.

16. A shower according to claim 4, wherein the fixed unit is disposed with a fixed shaft, the outlet unit is connected to the fixed unit and sleeved to the fixed shaft in rotating way;

the fixed shaft is disposed with external screw thread section;

the plate and the outlet unit are arranged concentrically to each other, configured to rotate synchronously and configured to slide up and down relative to each other, the plate is threaded to the screw thread section of the fixed shaft; wherein:

when the outlet unit rotates relative to the fixed unit, the plate rotates with the outlet unit, the plate is threaded and cooperated to the fixed unit to make the plate slide up and down relative to the outlet unit to make the plate move between the first state and the second state.

17. A shower according to claim 14, wherein the plate is provided with sealing columns equal in number to the diverters, wherein:

when the plate is situated in the first state, the sealing columns seal up the centre holes;

when the plate is situated in the second state, the centre holes are separated from the sealing columns.

18. A shower according to claim 15, wherein the plate is provided with sealing columns equal in number to the diverters, wherein:

when the plate is situated in the first state, the sealing columns seal up the centre holes;

when the plate is situated in the second state, the centre holes are separated from the sealing columns.

19. A shower according to claim 16, wherein the plate is provided with sealing columns equal in number to the diverters, wherein:

when the plate is situated in the first state, the sealing columns seal up the centre holes;

when the plate is situated in the second state, the centre holes are separated from the sealing columns.

* * * * *